United States Patent [19]

Sinclair

[11] Patent Number: 4,892,334

[45] Date of Patent: Jan. 9, 1990

[54] PORTABLE CLIPBOARD AND STORAGE BOX

[76] Inventor: Gary A. Sinclair, 22617 120th Ave. SE., Kent, Wash. 98031

[21] Appl. No.: 321,002

[22] Filed: Mar. 9, 1989

[51] Int. Cl.[4] ..... B42D 3/00

[52] U.S. Cl. ..... 281/45; 281/42; 108/42; 312/231; 248/441.1; 248/444

[58] Field of Search ..... 108/44, 43, 42, 23, 108/25, 38; 281/42, 45; 312/231, 237; 248/441.1, 444, 447.1

[56] References Cited

U.S. PATENT DOCUMENTS

| | | | |
|---|---|---|---|
| 2,240,035 | 4/1941 | Catherall | 292/251.5 |
| 3,922,973 | 12/1975 | Sturgeon | 108/44 |
| 3,977,744 | 8/1976 | DeWitt | 312/231 |
| 4,555,128 | 11/1985 | White et al. | 281/45 |
| 4,700,634 | 10/1987 | Mills et al. | 248/444 |

OTHER PUBLICATIONS

J. C. Whitney Parts and Accessories, Catalog, 1988, ©1987, Printed in U.S.A., p. 116.

*Primary Examiner*—Douglas D. Watts
*Assistant Examiner*—Thomas Hamill, Jr.
*Attorney, Agent, or Firm*—Jerry T. Kearns

[57] ABSTRACT

A portable clipboard includes an integral storage box for transporting various accessories such as pens, pencils, erasers, rulers, calculators, etc. The writing surface of the clipboard is provided with a spring retaining clip for securing papers and is mounted by a hinge to a shallow rectangular box. In a second embodiment, a battery operated light is secured by a flexible stem on the upper surface of the clipboard and a digital clock is also provided.

1 Claim, 3 Drawing Sheets

PORTABLE CLIPBOARD AND STORAGE BOX

BACKGROUND OF THE INVENTION

1. Field of the Invention

The present invention relates to portable clipboards, and more particularly pertains to a combined clipboard and storage box for transporting various accessories such as pens and pencils.

2. Description of the Prior Art

Various types of portable clipboards are known in the prior art. A typical example of such a portable clipboard is to be found in U.S. Pat. No. 2,862,328, which issued to S. Wadsworth on Dec. 2, 1958. This patent discloses a portable clipboard adapted for mounting within a vehicle. The clipboard includes a spring retaining clip for holding a writing instrument and a pivotal mounting bracket for adjusting the inclination of the clipboard writing surface. U.S. Pat. No. 3,922,973, which issued to H. Sturgeon on Dec. 2, 1975, discloses a portable desk for use in automobiles including a main housing with a chamber formed therein for storage of writing materials, forms and the like, and provided with a hinged lid which supports a plate carrying a clipboard. U.S. Pat. No. 4,274,567, which issued to P. Sawyer on June 23, 1981, discloses a clipboard organizer attachment for use on a shopping cart. The organizer includes a substantially flat desk panel provided with a spring clip for securement of a note pad or similar writing material. The upper end of the desk panel is hingedly secured to a receptacle which defines a compartment for receiving various materials such as coupons. U.S. Pat. No. 4,577,788, which issued to J. Richardson on Mar. 25, 1986, discloses a generally rectangular container adapted for mounting on a vehicle dashboard. The container includes both upper and lower removable lid and the container has a plurality of interior compartments for the storage of various articles. U.S. Pat. No. 4,619,386, which issued to J. Richardson on Oct. 28, 1986, discloses a generally rectangular vehicle desk which has a hinged upper lid provided with a spring retaining clip for holding paper or other writing material. The container includes a plurality of interior compartments for the storage of various accessory items.

While the above mentioned devices are suited for their intended usage, none of these devices disclose a portable clipboard formed as a shallow rectangular box and provided with a hinged cover with magnetic fastening means adapted for opening by the use of finger insertion notches. Additional features of the present invention, not contemplated by the aforesaid prior art devices, include the provision of a portable clipboard and storage box with a battery operated light and a digital clock. Inasmuch as the art is relatively crowded with respect to these various types of portable clipboards, it can be appreciated that there is a continuing need for and interest in improvements to such portable clipboards, and in this respect, the present invention addresses this need and interest.

SUMMARY OF THE INVENTION

In view of the foregoing disadvantages inherent in the known types of portable clipboards now present in the prior art, the present invention provides an improved portable clipboard and storage box. As such, the general purpose of the present invention, which will be described subsequently in greater detail, is to provide a new and improved portable clipboard and storage box which has all the advantages of the prior art portable clipboards and none of the disadvantages.

To attain this, representative embodiments of the concepts of the present invention are illustrated in the drawings and make use of a portable clipboard including an integral storage box for transporting various accessories such as pens, pencils, erasers, rulers, calculators, etc. The writing surface of the clipboard is provided with a spring retaining clip for securing papers and is mounted by a hinge to a shallow rectangular box. In a second embodiment, a battery operated light is secured by a flexible stem on the upper surface of the clipboard and a digital clock is also provided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable clipboard and storage box which has all the advantages of the prior art portable clipboards and none of the disadvantages.

It is another object of the present invention to provide a new and improved portable clipboard and storage box which may be easily and efficiently manufactured and marketed.

It is a further object of the present invention to provide a new and improved portable clipboard and storage box which is of a durable and reliable construction.

An even further object of the present invention is to provide a new and improved portable clipboard and storage box which is susceptible of a low cost of manufacture with regard to both materials and labor, and which accordingly is then susceptible of low prices of sale to the consuming public, thereby making such portable clipboards economically available to the buying public.

Still yet another object of the present invention is to provide a new and improved portable clipboard and storage box which provides in the apparatuses and methods of the prior art some of the advantages thereof, while simultaneously overcoming some of the disadvantages normally associated therewith.

Still another object of the present invention is to provide a new and improved portable clipboard and storage box for enabling the convenient transportation of writing accessories such as pens, pencils, erasers, rulers, calculators, and the like.

Yet another object of the present invention is to provide a new and improved portable clipboard and storage box which allows the convenient transportation of a writing surface and various writing accessories in a compact integral unit.

Even still another object of the present invention is to provide a new and improved portable clipboard and storage box which includes an attached battery operated light and a digital clock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
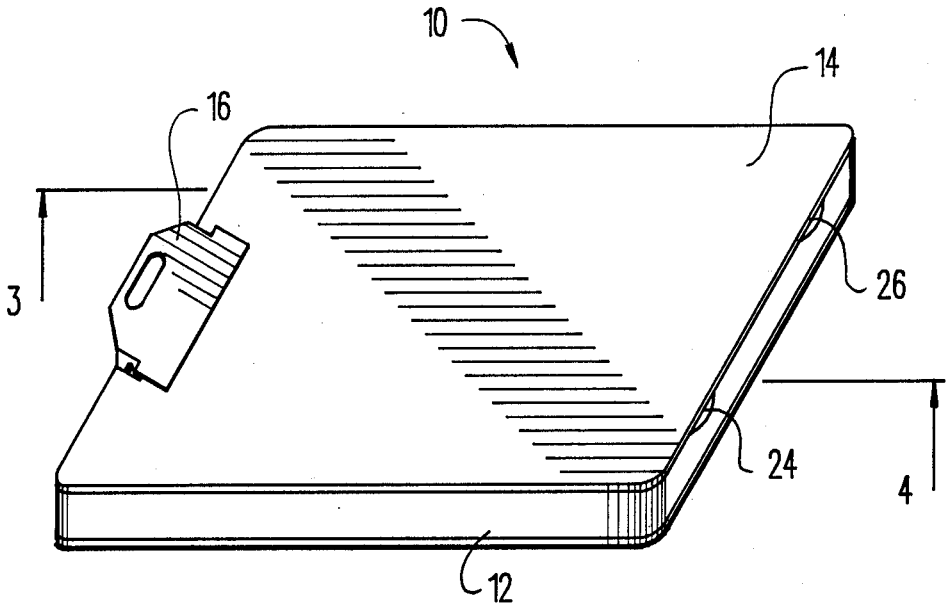
FIG. 1 is a perspective view of the portable clipboard storage box according to the first embodiment of the present invention.

With reference now to the drawings, and in particular to FIG. 1 thereof, a new and improved portable clipboard and storage box embodying the principles and concepts of the present invention and generally designated by the reference numeral 10 will be described.

More specifically, it will be noted that the first embodiment 10 of the invention includes a shallow generally rectangular box 12 having an attached hinged cover 14. A pair of notches 26 are provided in a front end wall of the box 12 to facilitate opening of the hinged cover 14. A conventional spring retaining clip 16 is secured adjacent an upper edge of the cover 14 for the securement of paper and similar writing materials.

Figure 2:
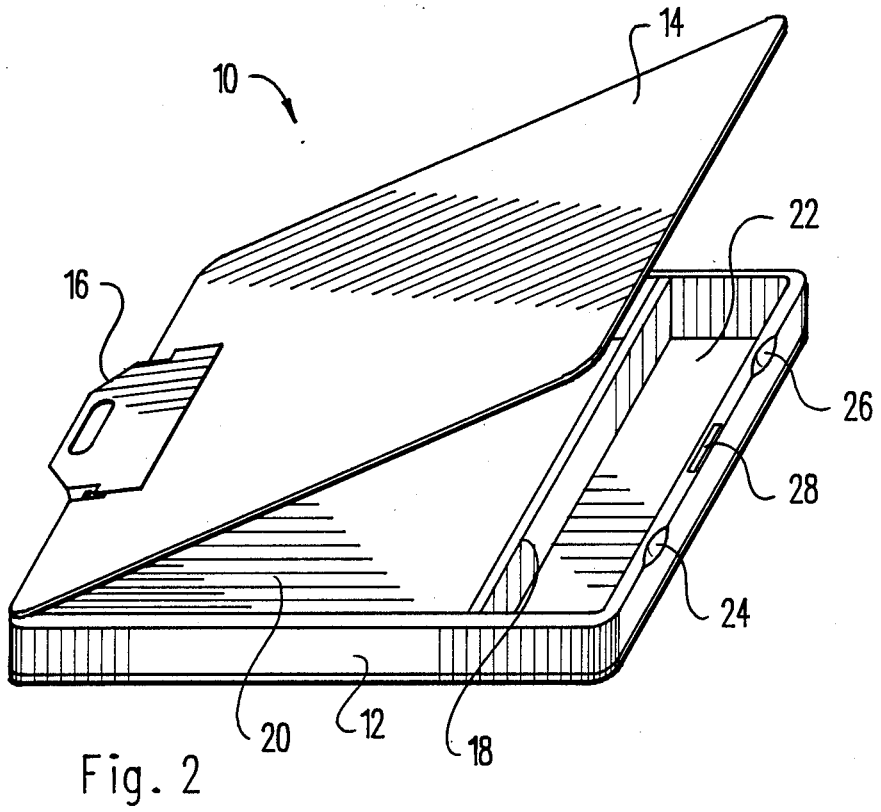
FIG. 2 is a perspective view illustrating the portable clipboard storage box of FIG. 1, with the cover in a slightly open position.

FIG. 2 illustrates the hinged cover 14 in a partially open position. The interior of the storage box 12 may be divided into compartments 20 and 22 by a dividing wall 18. The interior compartment 22 may be utilized to store a variety of writing instruments such as pens and pencils, while the larger compartment 20 may be utilized for the storage of writing materials such as paper, calculators, rulers and the like. A magnetic fastening element 28 is mounted on a bottom edge of the box 12 for cooperation with a similar magnetic fastening element on a bottom edge of the interior surface of the cover 14.

Figure 3:
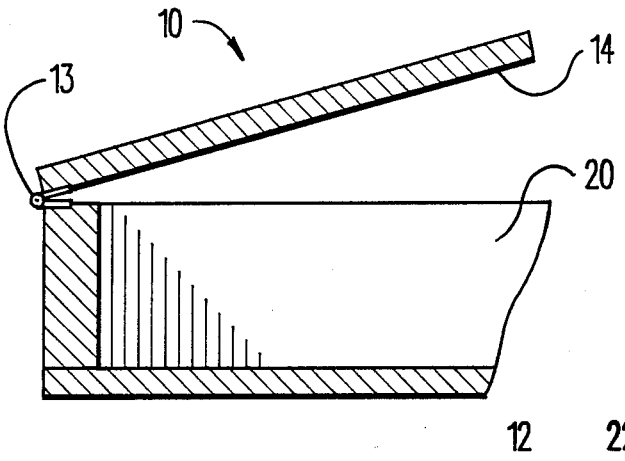
FIG. 3 is a partial cross sectional detail view, taken along line 3 of FIG. 1, illustrating the hinged mounting of the cover of the clipboard storage box.

FIG. 3 is a partial cross sectional view, taken along line 3 of FIG. 1, which illustrates the hinge 13 securing the cover 14 to the back edge of the box 12.

Figure 4:
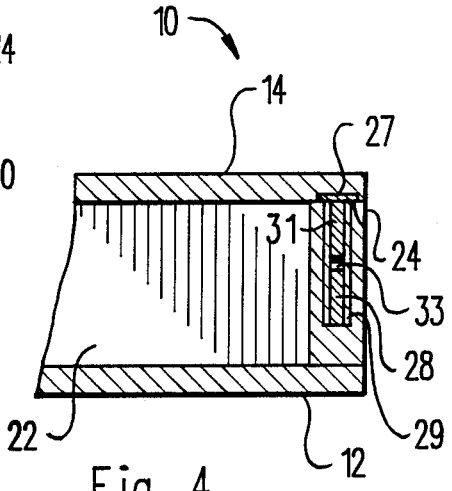
FIG. 4 is a partial cross sectional detail view, taken along line 4 of FIG. 1, illustrating the magnetic lid fastening closure.

FIG. 4 is a partial cross sectional view, taken along line 4 of FIG. 1, which illustrates the magnetic fastener plate 28 and a cooperating magnetic fastener 27 provided on the interior surface of the cover 14. The rectangular magnet 28 is sandwiched between steel side plates 29 and 31, which each include stamped transversely extending pegs which extend inwardly from their midsection through a transverse aperture 33 formed in the magnet 28. This arrangement secures the magnet 28 in place, and enhances the magnetic latching force. It should be noted that the fastener 28 may comprise a magnet and the fastener member 27 may comprise a steel plate. Alternatively, these components may be reversed.

Figure 5:
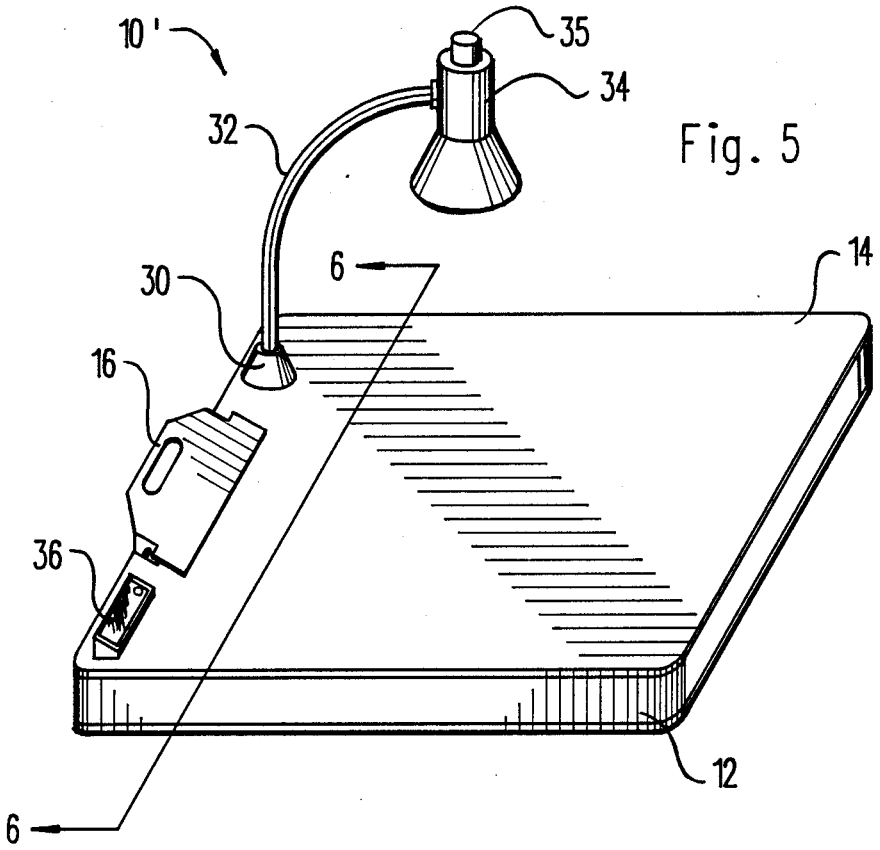
FIG. 5 is a perspective view illustrating a clipboard storage box according to a second embodiment of the present invention.

FIG. 5 illustrates a second embodiment 10' of the invention in which an electric lamp 34 is secured by a flexible stem 32 to a socket 30 provided adjacent an upper end of the cover 14. A switch 35 is provided for a selective activation of the lamp 34. A conventional battery operated digital clock 36 is also provided on the upper surface of the cover 14, on the opposite side of the spring retaining clip 16.

Figure 6:
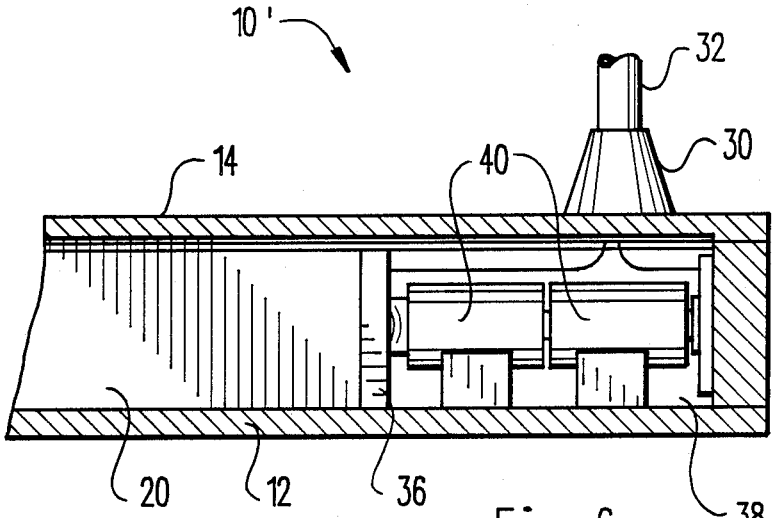
FIG. 6 is a partial cross sectional detail view, taken along line 6 of FIG. 5, illustrating the internal battery power source for the attached electric light.

As shown in the partial cross sectional view of FIG. 6, taken along line 6 of FIG. 5, a pair of conventional dry cell batteries 40 are disposed in an interior compartment 38 formed within the box 12 and are operatively connected for powering the lamp 34 by the illustrated wires extending through the socket 30 and through the interior of the flexible stem 32. A dividing wall 36 separates the battery compartment from the internal storage compartment 20.

Figure 7:
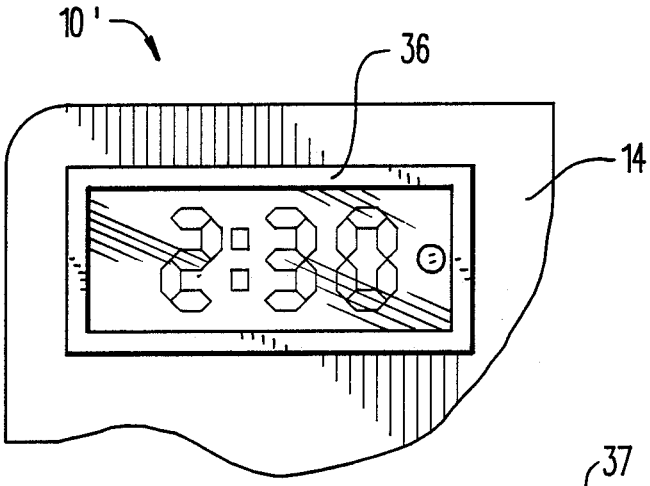
FIG. 7 is an enlarged partial detail view illustrating the digital clock on the hinged cover.

FIG. 7 provides an enlarged top detail view illustrating the battery operated digital clock 36.

Figure 8:
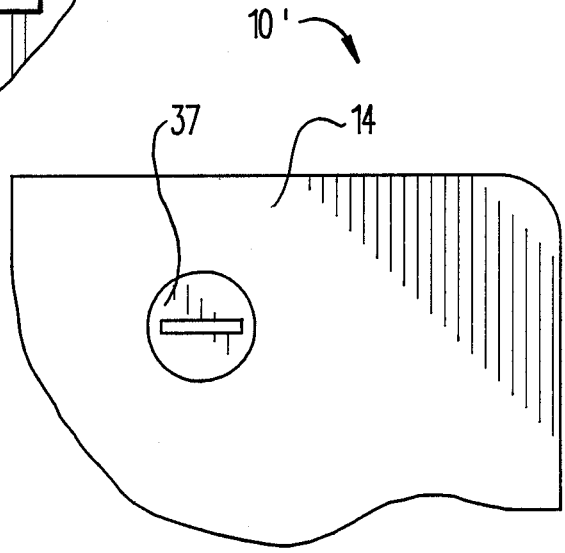
FIG. 8 illustrates the opposite side of the hinged cover and more particularly illustrates the clock battery access cover.

As shown in FIG. 8, the battery access cover 37 is formed in the bottom surface of the cover 14 and the clock 36 is preferably located in an integrally molded receptacle formed in the cover 14.

The various components forming the cover 14 and box 12 of the first 10 and second 10' embodiments of the present invention may be formed from a variety of conventional materials including wood, metal and plastic. As may now be understood, the clipboard storage box of the present invention provides an easily portable and compact integral unit which provides both a writing surface and a receptacle for the storage and transportation of various accessory items.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable clipboard and storage box, comprising:

a shallow generally rectangular box;

a cover mounted by a hinge on said box;

a spring retainer clip adjacent an upper edge of said cover;

cooperating magnetic fastening means adjacent an interior bottom edge of said cover and on a bottom edge of said box;

said magnetic fastening means comprises a rectangular magnet sandwiched between a pair of steel side plates and disposed within a bottom sidewall of said box, each of said steel side plates having an inwardly extending peg received through a transverse aperture formed through a midportion of said magnet;

a pair of spaced notches in said bottom edge of said box for opening said cover;

a light mounted by a flexible stem on said cover and operatively connected to a battery power source within said box; and a digital clock on said cover.

* * * * *